United States Patent [19]

Boij

[11] Patent Number: 4,544,348

[45] Date of Patent: Oct. 1, 1985

[54] APPARATUS FOR BURNING SPIRIT OR THE LIKE LIQUID FUEL

[76] Inventor: Karl O. A. Boij, Verkstadsgatan 8, S-573 01 Tranas, Sweden

[21] Appl. No.: 359,721

[22] PCT Filed: Jul. 10, 1981

[86] PCT No.: PCT/SE81/00212

§ 371 Date: Mar. 8, 1982

§ 102(e) Date: Mar. 8, 1982

[87] PCT Pub. No.: WO82/00332

PCT Pub. Date: Feb. 4, 1982

[30] Foreign Application Priority Data

Jul. 11, 1980 [SE] Sweden ..... 8005113
Jul. 11, 1980 [SE] Sweden ..... 8005114
Nov. 28, 1980 [SE] Sweden ..... 8008373

[51] Int. Cl.[4] ..... F23Q 25/00

[52] U.S. Cl. ..... 431/146; 126/43; 431/314

[58] Field of Search ..... 431/146, 152, 310, 313, 431/314, 321, 326; 126/43

[56] References Cited

U.S. PATENT DOCUMENTS 1,013,271 1/1912 Brown et al. ..... 431/314
1,933,318 10/1933 Doen ..... 431/350
3,290,907 12/1966 Boij et al. ..... 431/146
3,316,957 5/1967 Stockli et al. ..... 431/152
3,606,609 9/1971 Lipper et al. ..... 126/43
3,627,463 12/1971 Boij ..... 431/326
4,416,617 11/1983 Ebbeson ..... 126/43

FOREIGN PATENT DOCUMENTS 682624 3/1964 Canada ..... 126/43

*Primary Examiner*—Carroll B. Dority, Jr.
*Attorney, Agent, or Firm*—Curtis Ailes

[57] ABSTRACT

Apparatus for burning spirit or similar fuel with a fuel container (10) filled with a fuel absorbing mass with partly exposed surface, from which fuel to be burned evaporates. A burner tube (16) is so arranged with respect to the exposed surface that suction of combustion air into the tube is secured. The fuel container is separate and removable from the apparatus and has top, bottom and side walls enclosing the absorbing mass. The top wall for forming the exposed surface includes a central opening, the area of which comprises a fraction of the total area of the upper top wall. The opening is surrounded by a rim portion (26) of the top wall substantially raised with respect to the rest of the top side of the container. The tube (16) is surrounded by an outer fixed tube (20) with an upper end extending above the level to which the burner tube is normally intended to extend. A band shaped wick means (122) is located in the mass at a distance from the bottom and side walls of the container and has a first portion (124) with a large surface extending near and essentially parallel to the bottom of the container, and two second wick portions extending from the first portion towards the top side of the container.

11 Claims, 7 Drawing Figures

APPARATUS FOR BURNING SPIRIT OR THE LIKE LIQUID FUEL

Figure 1:
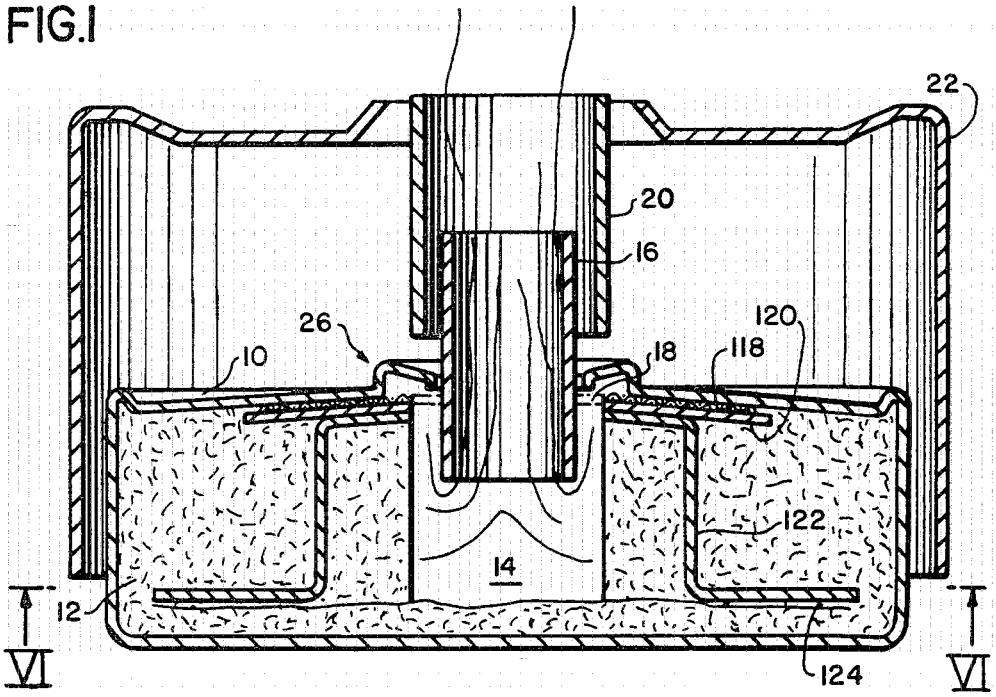

The present invention generally relates to apparatus for burning spirit or the like liquid fuel, more particularly fuel containers for such apparatus, and specifically such containers, which are filled with a fuel absorptive mass. In one type of apparatus the combustion takes place along an exposed horizontal surface of the absorptive mass, usually called apparatus with horizontal surface combustion. In another type of burning apparatus the container has a preferably vertical channel with an entirely or partly exposed surface, from which fuel to be burned evaporates.

According to a first aspect the invention particularly relates to an apparatus for burning spirit or similar liquid fuel, with a fuel container filled with a fuel adsorbing mass with partly exposed surface, from which fuel to be burned evaporates, a draught or burner tube being so arranged with respect to the exposed surface that suction in of air in the tube is secured, the fuel container being separate and demountable from the rest of the apparatus and having upper, bottom and side walls enclosing the absorbing mass, the upper wall including a central opening for forming the exposed surface, the surface of said opening forming a smaller part of the total surface of the top wall.

A first object of the invention is to provide improved fuel containers, at which particularly different problems connected with the fuel and its refilling, ignition and extinction have been solved.

In a plurality of embodiments of spirit stoves it occurs that the flame is controlled and extinguished with a cover, throttle, disc or the like. Under certain circumstances it can happen that the flame nevertheless has not completely gone out after the extinguishing operation proper, but a greater or smaller flame "hangs around" at or in the vicinity of the extinguishing means due to leakage of spirit vapour. At the corresponding point spot leaking fuel vapours can also under unfavourable circumstances catch fire from an adjacent fire, e.g. from burning flame on a multiflame cook or heating apparatus.

The problem is greatest in connection with fuel containers which are more or less overheated, and one can never neglect that the fuel container can be overheated to near or above the boiling point of the fuel. The problems not less apply to stoves of the type discussed briefly above, i.e. low pressure stoves for spirit with partly exposed absorbing mass in the fuel container.

What is important in connection with the extinction of the stove is that a small "remaining residual flame" cannot "grow" by further heating of the fuel or vital parts of the fuel container. Instead the flame shall go out by itself due to cooling down burner portions and decreasing evaporation from the fuel.

A first specific object of the invention is to decrease the problems in connection with extinction. This object has been attained in an apparatus according to the first aspect in that the opening is surrounded by a rim portion of the top wall substantially raised with respect to the rest of the upper side of the container.

In fuel containers with fuel bound in an absorption mass there can be problems to completely bind all fuel that can be supplied to the container at filling. Particularly, this is true in containers which have greater length or width than height, if the container is filled in an horizontal position.

By giving to a fibrous mass, e.g., mineral wood, an adapted packing degree a relatively good fuel binding is obtained, but hardly that good that no spirit flows out of the refilling opening of the container if the container is raised to a vertical position after filling.

By raising the container to a vertical position one can thus deliberately obtain a certain pouring out of fuel that can otherwise cause problems and danger in case of unintentional leaning of the container. An intentional pouring out of excess fuel by inherent pressure outflow can, however, be quite time consuming if freedom of spillage is required.

A second specific object of the invention is to provide a container design that makes possible acceleration of the pouring out of excess fuel so that the fuel container then can be handled in any position without risk of spillage. This object has been attained in a fuel container for an apparatus for burning spirit or the like liquid fuel, said container being filled with a fuel adsorbing mass in a housing, that is completely closed except for an opening in the top side of the container, characterized in that wall portions of the top and/or bottom side of the container are at least partly resilient.

In containers of the above-mentioned surface combustion type problems occur in connection with precipitation of less volatile components of the fuel on the surface of the absorptive mass, said components successively stopping up the mass and causing clogging of the necessary porous surface.

A third specific object of the invention is to provide a solution to the clogging problem. This object has been attained in a fuel container for an apparatus for burning spirit or the like liquid fuel, said container being filled with a fuel absorption mass and having an opening in its top side, within which said absorptive mass has an upwardly exposed surface, characterized in that the exposed surface is covered with a layer of exchangeable porous mass, e.g. of the type glass fibre or down, asbestos or the like.

A fourth specific object related to apparatus of the surface combustion type, is to provide a container that makes easier filling of fuel and ignition of the same. This object has been attained in a fuel container for an apparatus for burning spirit of the like liquid fuel of the type where the burning is a so called surface combustion within an upwardly exposed surface of an absorptive mass for the fuel located in the container, characterized in that the container has an opening in the form of a shaft extending from the exposed surface downwardly into the absorptive mass for making easier refilling and ignition.

One cannot neglect the risk that fuel container in stoves under unfavourable conditions can be overheated up to the boiling point of the fuel or higher. The fuel containers should therefore be designed in such a way that dangerous over-pressure or over-boiling cannot occur. This is true not least for fuel containers with absorptive mass. The containers should also be designed in such a way that they not easily spill spirit in connection with otherwise not unnormal manipulation.

As regards the absorptive mass it can be said that the more porous it is the greater fuel transformation can it handle at overheating. Less dense mass, however, involves a greater risk that the fuel flows out. With increasing density of the mass also its absorption ability increases, the risk for over-pressure being then, however, greater in case of over-temperature. A wick is needed to transport fuel to the surface of the mass where burning occurs in order to prevent dry burning at this when the fuel amount is relatively small in the container. In order to make easier this function the wick should have a through-flow section as great as possible. On the other hand, a great surface of vertical portions of the wick implies that liquid movements and vapours at overheating are slowed down, which once again can give rise to over-pressure.

A fifth specific object of the invention is to fulfill the above stated desires at so called, "open" fuel containers with absorptive mass by means of a container design that makes possible that the fuel container can be supplied with essentially only the amount of fuel that the absorptive mass satisfactorily is capable of binding, the stated wick problems being simultaneously solved. This has been attained in an apparatus for burning spirit or the like liquid fuel with a container filled with a fuel absorptive mass and having an opening in its top side exposing said mass, characterized in that an essentially band shaped wick means located in the mass at a distance from the bottom and walls of the container has a first portion with a great surface extending nearby and essentially parallel to the bottom of the container, two wick portions extending from the first portion against the top side and opening of the container, said second portions being located essentially diametrically opposite to each other with respect to the centre axis of the opening and having a small surface.

A sixth specific object of the invention is to decrease the height of an apparatus for burning spirit or the like liquid fuel including a separate and demountable fuel container filled with a fuel absorbing mass with partly exposed surface from which fuel to be burned is evaporated, a flame concentrating tube separated from the fuel container being so arranged with respect to the exposed surface that suction in of combustion air in the tube is secured. This object has been attained in that the tube is surrounded by an outer preferably fixed tube over one end of which the inner tube normally is not intended to extend.

In an apparatus of the kind just mentioned the efficiency can be increased during burning, at the same time at least considerably decreasing the black and carbon monoxide formation, if according to one embodiment a flame spreading means is located in association with the upper end of the outer tube, and the outer tube is surrounded by a second preferably fixed tube which at least partly also encloses the flame spreading means.

Figure 2:
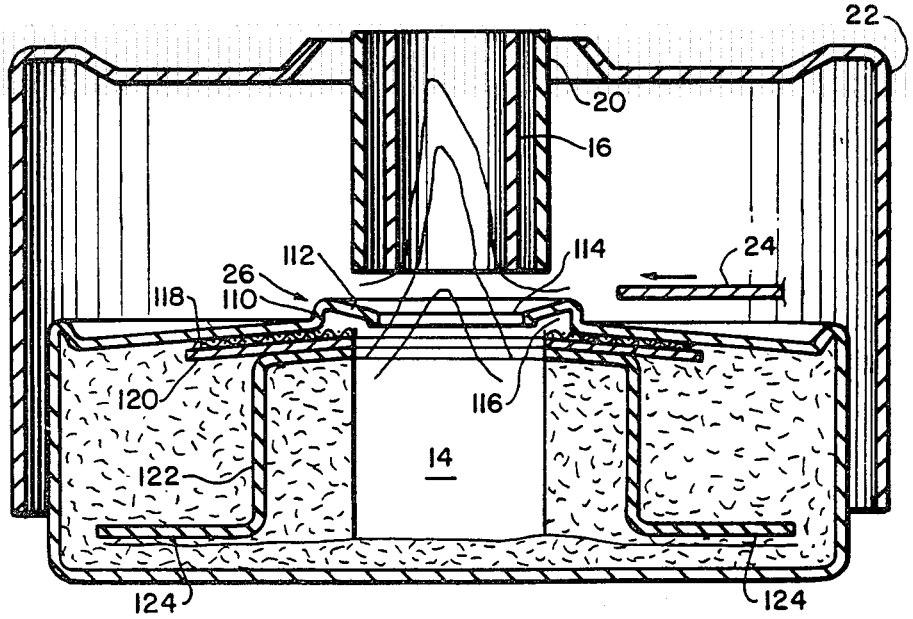
Figure 3:
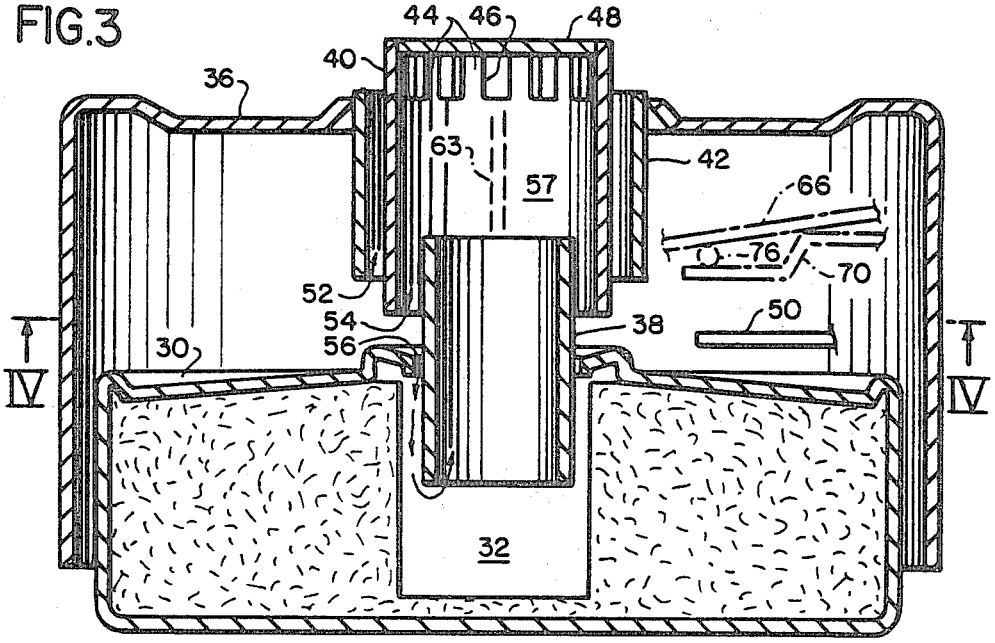
Figure 5:
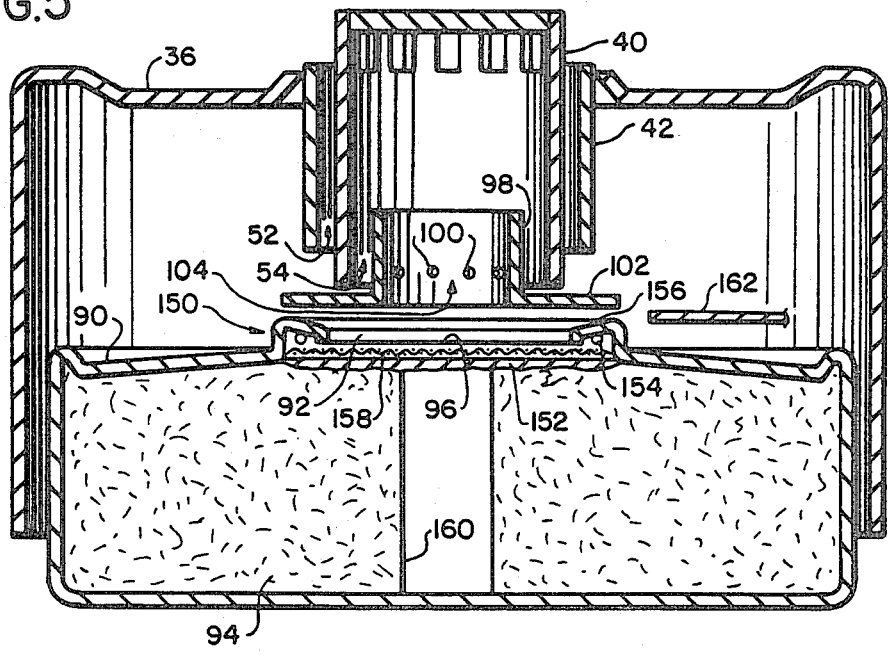
Figure 6:
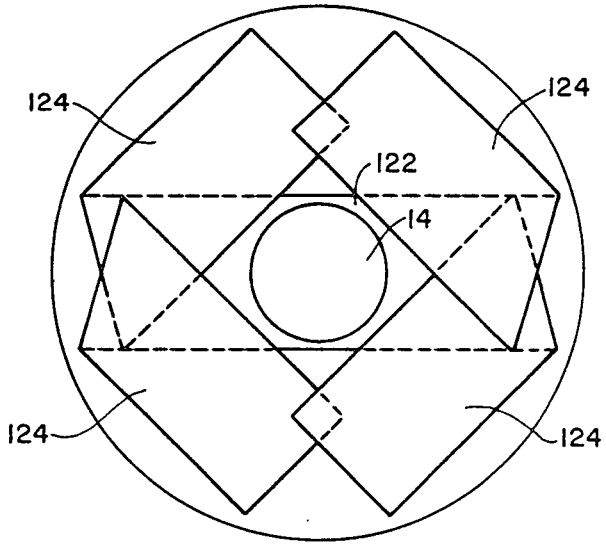

Different embodiments of the invention shall now be described more closely below with reference to the attached drawings, on which FIGS. 1 and 2 in axial section show a first embodiment, FIGS. 3 and 4 in an axial section and a section, respectively, in the direction of arrows IV—IV in FIG. 3, illustrate a second embodiment, FIG. 5 shows a third embodiment in axial section, FIG. 6 in section in the direction of arrows VI—VI in FIG. 1 shows a wick arrangement, and FIG. 7 in a schematic section illustrates an extinguishing disk arrangement.

The apparatus for burning spirit or similar liquid fuel illustrated in FIGS. 1 and 2 can generally be of the type disclosed in the U.S. Pat. No. 3 627 463. It has a fuel container 10 filled with a fuel absorptive mass 12. In this mass a preferably vertical channel 14 is arranged from which fuel to be burned evaporates. A draught or burner tube 16 forms an extension upwardly of the burning channel 14 and is so dimensioned and arranged with respect to this that an annular gap 18 for suction in of combustion air is formed between the tube and the combustion channel. More particularly the draught tube 16 is settable to different vertical positions with respect to the combustion channel for controlling the magnitude of the flames such as appears from the comparison between FIGS. 1 and 2. The vertically shiftable draught tube 16 can also be provided with air intake holes not shown and is surrounded by an outer tube 20 which can be fixed with respect to the container 10, e.g. be attached to this or to an outer housing 22 for it by means of suitable support members. A disk 24 is introducable into the gap between the lower edge of the outer tube 20 and the top side of the container 10 for covering the combustion channel and thereby extinguising and controlling the flame. The disk 24 can, however, be displaceably or pivotally attached to the fuel container or said outer housing and cooperates in a way to be described more closely below with a raised annular rim 26 of the top side of the container.

The general function of the vertically shiftable draught tube 16 appears clearly from U.S. Pat. No. 3 627 463 and need therefore not be described more closely here. As appears from a comparison of FIGS. 1 and 2 the magnitude of the flame or the intensity of the combustion increases within certain limits when the draught tube 16 is displaced into the combustion channel 14.

In the apparatus according to the said patent the single draught tube has been given a certain smallest length in order to be able, in its most inserted operational position in the combustion channel 14, to serve simultaneously as a wind shield with its upper portion. In the apparatus shown on the attached FIGS. 1 and 2 this function has been taken over by the outer tube 20. Thereby it has been possible to decrease the length of the displaceable draught tube so that its upper edge in the position allowing introduction of the extinguishing disk 22 at least not essentially extends out of the tube 20. The level on which the cooking vessel support is located is thereby determined essentially by the height of the tube 20 and not, as in the earlier apparatus, by the height of the draught tube in its most upwardly displaced position.

By arranging, in the way described above, a fixed tube that coaxially surrounds the draught tube one can in most cases attain certain further important advantages which will appear more closely from the description of the next embodiment.

In FIG. 3 the fuel container is designated 30 and the combustion channel in the fuel absorbing mass 34 is designated 32. The outer housing of the apparatus is designated 36. Furthermore, the vertically displaceable, with air intake holes, if any, provided tube is designated 38 and the fixed outer tube, corresponding to the tube 20 in the preceding embodiment, is designated 40. The arrangement includes a further, preferably fixed tube 42 that surrounds the tube 40.

Above the tube 40 there is a flame spreading arrangement. This flame spreader can be fixedly connected to the tube 40, preferably at least partly be integral with this, as appears from the Figure. More particularly, the upper portion of the tube 40 is provided with oblong holes 46 separated by narrow wall portions 44. The width of the holes 46 can be of an order of magnitude of 6–7 mm and the width of the wall portions 44 of an order of magnitude of 4–5 mm. The upper end of the tube 40 is provided with a cap 48.

At 50 an extinguishing disk with the same function as the disk 24 in the preceding embodiment is furthermore indicated.

During combustion in the apparatus shown in FIG. 3 three air flows according to the arrows 52, 54 and 56 occur. The action of the air flow 56 taken in through the annular gap between the tube 38 and the combustion channel 32, appears more closely from the U.S. Pat. No. 3 627 463 and need therefore not be described here. The air flow 54, arising from the fact that cooler surrounding air is drawn in into the gap between the tubes 38 and 40, is heated and mixed into the flame above the tube 38.

The partly closed space that is sidewardly limited by the wall of the tube 40 above the tube 38, in fact, functions as a very effective mixing chamber 57 for the air flow 54 and the flame coming out of the tube 38, said flame thereby being brought to high temperature. The flame is divided by means of the portions 44 into a number of small flames coming out of the tube 40 via the openings 46. The warm and rapidly rising air flow 52 urges these small flames upwardly and increases the mixing in of air maximally during the combustion. This occurs in that each small flame, emerging from its respective opening 46, from all sides is surrounded by its portion of the air flow 52 and is thereby subject to a very efficient air admixture and strong oxygen supply. The air flow 52 also prevents the small flames from flowing together so that the air admixture in question occurs right to the moment the flames hit the boiling vessel bottom.

It has turned out that one with burning apparatus of the kind just described has obtained an almost complete combustion without noticeable black formation and with the content of carbon monoxide considerably below recommended values. At the same time an acceptable boiling time is obtained.

The tubes 40 and 42 can be carried via supports, not shown, by the container 30 and/or the housing 36. In FIG. 4 which illustrates a section in the direction of arrows IV—IV in FIG. 3 a solution is shown which then also makes the tube 38 easily accessible for vertical manipulation. More particularly the tubes 40 and 42 consist of axially cut tube halves with flanges 60 and 62, respectively, which are connected together and between them form two diametrically opposite longitudinally extending slits 63 in the tube 40 and 42. Via these slits the free legs 64, directed towards each other, of a yoke 66, can be introduced into holes in the wall of the tube 38 such that the loop 66 is pivotal about the legs 64 with respect to the tube 38. The transversely extending end portion 68 of the yoke 66 can be pivotally arranged about its length axis in structure associated with the housing 38 or the fuel container. A manipulation shaft 70 is rotatably mounted in a portion 72 of the housing and at its free end has a manipulation nob 74. At the other end the manipulation shaft 70 carries a cam means by means of which a transverse leg 76 of the yoke can be brought up and down so that the whole yoke pivots about the shaft 68 and the yoke thereby moves the tube 38 in a desired direction. This cam means can e.g. be as shown in FIG. 4 and consist of a bent end portion 78 of the shaft 70. In FIG. 3 the position of details 63, 66, 70 and 76 has been schematically indicated by means of broken lines.

Figure 4:
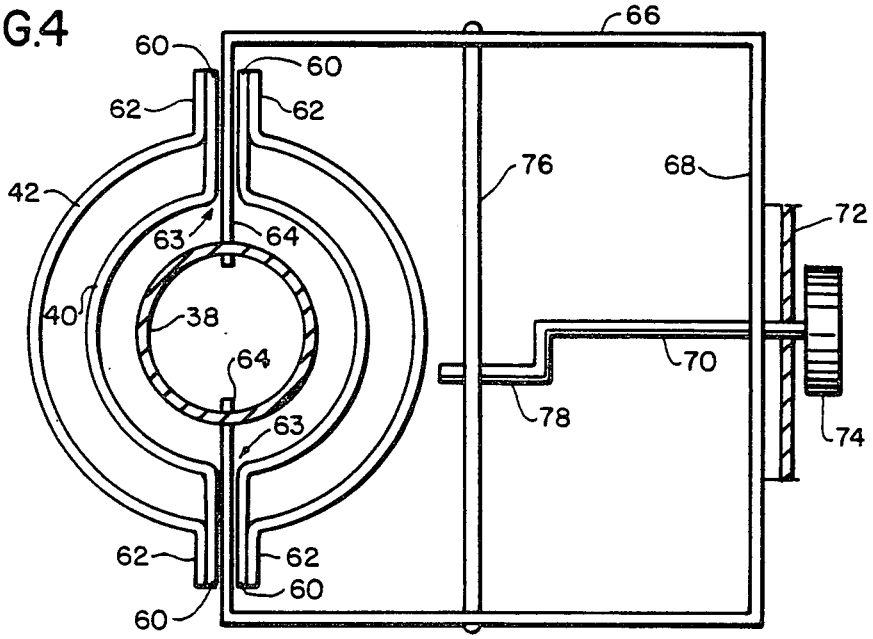

The embodiment according to FIGS. 3 and 4 is very well adapted for indoor use due to the low carbon monoxide formation.

Also in the embodiment according to FIGS. 1 and 2 one can obtain a certain mixing chamber effect by suitable dimensioning of the gap between the inner and outer tube. It can, however, in certain connections be suitable to decrease the gap between the tubes to that which is needed only for not obstructing the shifting movement of the draught tube.

The embodiment with the flame spreading arrangement according to FIG. 3 can, however, also be used in apparatus of the so called horizontal surface combustion type. An example of this is shown in FIG. 5. In the cover wall of the fuel container 90 a central opening 92 is located. Within this opening the upper surface of the fuel absorbing material 94 filling the container is exposed.

The movable tube 38 in the embodiment according to FIG. 3 is replaced by a fixed, flame collecting tube 98. The tube 98 can have air intermixing holes 100 and carries at its lower edge a disk 102 that extends over the exposed surface. In operation the combustion occurs along the surface 96 in known manner. The air intake arrow 104 corresponds to the arrow 56 in the preceding embodiment and the flame spreading arrangement functions in a similar way as in that embodiment. The advantages are also here above all a low carbon monoxide content and a far-reaching freedom of black formation.

In the containers according to FIGS. 1–3 the substantially raised rim portion 26 includes an outer annular side wall 110, an annular upper wall 112 and an inner annular folded down edge 114. Defined by said portions an annular empty space 116 is formed within the rim portion 26 down to the absorbing mass. A venting net 118 extends around the shaft 14 between the upper wall and the absorption mass in the manner shown. The shaft 14 has a diameter that exceeds the inner diameter of the raised rim 26.

The container has a wick system including an upper glass down layer 120 extending around the shaft. The layer 120 can consist of a number of glass down layers. Furthermore the wick system includes a wick band 122 with a width somewhat exceeding the diameter of the shaft. The band 122 extends from a lower horizontal portion located near but at a distance from the underside of the container, vertically upwardly along the side of the shaft to the layer 120 and over the shaft with an opening corresponding to the diameter of the shaft. On the other side of the shaft the band deviates in the same way from the shaft 120 vertically downwards to a lower horizontal portion located near but at a distance from the bottom of the container. The wick band 122 can consist of a number of glass down layers. At the free ends thereof, i.e. at the lower portions of the wick band, the band is much or considerably longer than the outer diameter of the container, portions of the band then being folded in each its corresponding direction as appears from FIG. 6. Thus, two layers of the band can e.g. be folded in each its direction. By means of these folded flaps a wick layer 124 is formed with a great surface approximately on level with the bottom of the shaft, despite the comparatively narrow width of the wick band.

As was mentioned above it can be stated regarding the absorptive mass that the more porous it is the greater fuel transformation can it handle in case of overheating. Less dense mass, however, involves greater risk that the fuel will flow out. With increasing density of the mass also its absorption ability increases, the risk for overpressure then, however, being greater in case of overtemperature. The wick 120, 122, 124 is needed to transport fuel to the combustion shaft in order to prevent dry burning in this, when the fuel amount is relatively small in the container. In order to facilitate this function the wick should have a through-flow section as great as possible, i.e. a great width of the wick band 122 if one at the same time wants that the wick material shall intrude as little as possible upon the volume of the absorption mass. On the other hand, a great width of the vertical portion of the wick band implies that liquid movements and vapours in case of overheating are slowed down, this once again being able to give rise to overpressure. The vertical surface of the wick band surrounding the shaft 14 should preferably not cover more than an order of magnitude of 50% of the throughflow section to the shaft.

By locating the lower horizontal wick portion 124 at a distance from the bottom and sides of the container the risk for overheating of the liquid in the wick become smaller in case of local heating of the bottom wall and side walls of the container.

Figure 7:
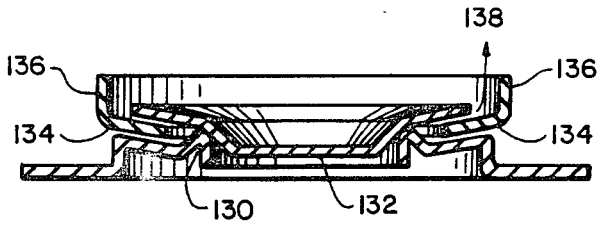

In FIG. 7 an extinguishing disk arrangement is schematically illustrated in connection with a fuel container with a substantially raised rim portion around the opening into the absorption means. The rim portion is here formed with an inner annular raised portion 130 but has for the rest essentially the same shape as in FIGS. 1–3. The extinguishing disk includes two portions, viz. a disk shaped circular portion 132 formed to cooperate with the raised portion 130, and an annular portion 134 with upwardly directed edge 136 essentially shaped to cooperate with the rim portion outside the raised portion 130. In case of extinguishing a remaining flame is directed in the direction of the arrow 138 straight upwards from the container.

The container should preferably be filled vertically or having a slope more than 45° from the horizontal. The annular space under the rim portion 26 and the greater diameter of the shaft as compared with the inner diameter of the rim portion then serve as a security against sudden overflow of the liquid. The filling is stopped when one observes that liquid starts to collect along the side of the shaft that is lowest of the tilted container. Continued filling implies that excess fuel flows over the rim, overfilling then being prevented.

In order to preferably secure that in case of need there will always be an expansion space in the absorption mass the filling should preferably always take place with the same portion of the container directed upwardly. For this purpose an indication of some kind can be applied well visible on the container, e.g. in the form of a great arrow on the container upper wall, which points towards the edge to be held lowermost during filling. This direction can furthermore preferably coincide with the diametric direction, in which the band extends, filling then always taking place towards a space with the greatest possible wick volume.

The forming of the shaft with greater diameter than the inner diameter of the rim portion can, for the above mentioned purpose, be replaced by some equivalent arrangement. Thus the shaft can, per se, have the same or even smaller diameter than the inner diameter of the rim, but then in connection to the empty volume 116 under the rim portion have a great recess in the wall of the shaft in the direction of the filling arrow or the like.

The mutual dimensioning of absorption mass, wick, shaft diameter/magnitude of the recess, if any, and rim portion 26/space 116 is carried through such that the above stated desires are fulfilled in an optimal way while considering the further desire that the container shall be able to contain a great amount of fuel.

In the container according to FIGS. 1–3 the shape of the rim portion 26 is such that it can either receive a plug or a surrounding lid, this element then forming an evaporation seal.

As mentioned above the container of the embodiment according to FIG. 5 is intended for so called surface combustion along the horizontally exposed surface 96 of the absorption mass within the opening 92. The rim portion of the opening 92 has a substantial raise 150 over the associated portion of the container cover in the same way as in the embodiments according to FIGS. 1–3. On the exposed surface of the absorption mass in the opening 92 a thin absorbing extra protective layer 152 of glass down, asbestos or the like is removably arranged. This layer is kept in place by means of an open and expandable ring 154 with resilient properties between the radial portion 156 of the raise and a wire cloth or the like 158 covering the glass downe layer 152. The ring 154 can e.g. along its full length be zigzag shaped so that portions of it extend a distance inwardly over the metal cloth 158.

The bottom and/or upperside of the container by suitable dimensioning of its thickness and drawing treatment during the manufacture of the container is made to be flexible and resilient in case of pressing in a container even if it is packed with absorption mass.

A central opening 160 can be arranged in the absorption mass as an expansion space and for making easier refilling of the fuel. Furthermore, it can also serve to facilitate ignition, the layer 152 and cloth 158 then having corresponding openings.

The raised opening rim 150 around the opening 92 has multiple functions, which in applicable cases also applys to containers of the kind shown in FIGS. 1–3. If the flame is extinguished by placing a lid, throttle, disk, or the like, over the combustion surface it secures that a remaining flame is kept at a distance from the rest of the upper wall of the container. This function is amplified by the inwardly sloping surface 156 which directs the gases obliquely upwardly at extinguishing.

The distance between the highest level of the opening rim and the level of the surrounding container cover can be of an order of magnitude of 3–10 mm, preferably at least 5 mm.

As was the case in the earlier described embodiment with shaft, the raised rim can also here serve for providing a collecting space in case of refilling. Likewise a local recess in the absorption mass can serve this purpose.

Thus, preferably a certain smallest distance should exist to the level of the combustion surface and most preferably this should be of an order of magnitude of at least 2 mm and is determined e.g. by suitable dimensioning of the ring 154. The magnitude of the distance is determined in practice by the type and the fuel density of the absorption material.

The opening rim can preferably serve as a seat for a control and extinguishing disk 162 which is sidewardly introducable over the combustion surface for control and extinguishing purposes. At extinguishing it occurs rather often that a secondary flame can remain in association with the extinguishing disk and heat it. If the distance to the combustion surface is then too small the temperature thereof can thereby likewise be increased with the result that the vapour pressure in the closed space over the combustion surface increases, this in turn in unfortunate cases giving rise to increasing strong flame formation.

In containers for apparatus of the kind shown in FIGS. 1–3 where the flame is controlled with a draught tube that is vertically displaceable in a shaft in the absorption mass the distance from the upper surface of the raised opening rim to the absorption mass of the shaft can suitably of the same reason be of an order of magnitude of approximately 5 mm, preferably of an order of magnitude of 8–10 mm.

The raised portion can, due to its stiffened shape, also serve as a base for attaching the manipulation mechanism of the extinguishing disk and other manipulation devices and accessories in apparatus of the horizontal surface combustion type as well as of the type with draught combustion tubes.

The resilient forming of the cover wall and/or the bottom of the container, which can also be used with containers of the type shown in FIGS. 1–, has the following function in connection with pouring out excess fuel after refilling. After refilling, the container is raised vertically such that the opening is directed obliquely downwardly with the vertical passing approximately through the lowest portion of the rim of the opening and the highest portion of the bottom edge of the container. Then the resilient properties of the bottom and/or cover are used for pumping a number of times bottom and upper wall towards each other, whereby drain away of excess fuel, if any, is accelerated. The fuel container can thereby then be manipulated in an arbitrary position without spillage risk.

The exchangeable glass down layer provided on the exposed surface of the absorption mass can be replaced by a new one after precipitation of less volatile components of the fuel has resulted in clogging of its pores.

I claim:

1. Apparatus for burning spirit or similar liquid fuel including a container filled with a fuel absorbing mass with a partly exposed surface from which fuel to be burned evaporates and along which combustion takes place, a draft or burner tube positioned and arranged with respect to the exposed surface to provide suction of combustion air into the tube, the fuel container being separate and removable from the rest of the apparatus and having top, bottom, and side walls enclosing the absorbing means, the top wall including a single opening which is centrally located for exposing the partly exposed surface of the fuel absorbing mass, the area of said central opening comprising a minor portion of the total area of the top wall, means operable to position said burner tube above the edge of said opening, a substantially flat control and extinguishing disk arranged to be moved to partially or completely cover said central opening when said burner tube is positioned above the edge of said opening to control or extinguish the burning of the fuel, the edge of said opening consisting of a rim portion of the top wall substantially raised above the rest of the top side of the container and having an annular upper surface against which the control and extinguishing disk is movable into contact and a lower annular surface spaced above the remainder of the lower surface of the top wall, the side and upper walls of said rim portion including said annular upper surface being imperforate, the upper surface of said fuel absorbing mass being spaced beneath said raised rim portion to define an open space beneath said rim portion and extending radially inwardly therefrom.

2. Apparatus according to claim 1, characterized in that the annular upper surface of said rim portion slopes inwardly towards the opening.

3. Apparatus according to claim 1 or 2 wherein the exposed surface is covered by a layer of a replaceable porous mass such as glass down, asbestos or the like, said porous mass being covered by a metal cloth and being kept in place by a peripherally arranged resilient ring positioned between the mass and an inner abutment of the raised rim portion.

4. Apparatus according to claim 1 or 2, characterized in that the annular upper surface has an inner annular folded down edge.

5. Apparatus according to claim 1 or 2 with a burner channel coaxial with the opening, characterized in that the diameter of the channel is greater than the inner diameter of the area of said central opening.

6. Apparatus for burning spirit or similar liquid fuel including a separate and demountable fuel container filled with a fuel-absorbing mass with a partly exposed surface from which fuel to be burned evaporates and along which combustion takes place, a flame collecting tube separate from the fuel container and being so arranged with respect to the exposed surface that suction of combustion air into the tube is provided, said tube being surrounded by an outer fixed tube extending above the normal highest position of the upper end of said flame collecting tube, said outer fixed tube including a closure at the upper end thereof, and the upper end of said outer fixed tube, with said closure, including a plurality of separate circumferentially arranged flame openings for providing a flame spreading device, said outer tube being surrounded by a second fixed tube that at least partially surrounds the flame-spreading device.

7. Apparatus according to claim 6 characterized in that it is of the surface combustion type with a horizontal exposed surface and with a fixed flame collecting tube and with a lower disk provided thereon extending over said exposed surface at a distance therefrom, the lower edges of the first and second outer tubes being spaced from the top side of the disk.

8. Apparatus for burning spirit or similar liquid fuel including a separate and demountable fuel container filled with a fuel absorbing mass with a partly exposed surface from which fuel to be burned evaporates and along which combustion takes place, a flame collecting tube separate from the fuel container and being so arranged with respect to the exposed surface that suction of combustion air into the tube is provided, said tube being surrounded by an outer fixed tube extending above the normal highest position of the upper end of said flame collecting tube, at least a portion of said exposed surface of said fuel absorbing mass being formed to define a vertical burning channel in the absorption mass, means for adjusting said flame collecting tube vertically in said burning channel for controlling the magnitude of the flame, said burning channel being larger than said flame collecting tube to form an annular gap therebetween for suction of combustion air, said outer fixed tube including a closure at the upper end thereof, and the upper end of said outer fixed tube, with said closure, including a plurality of separate circumferentially arranged flame openings for providing a flame-spreading device, said outer tube being surrounded by a second fixed tube that at least partially surrounds the flame-spreading device.

9. Apparatus according to claim 6, 7 or 8, characterized in that the flame spreading device includes vertically positioned oblong holes associated with the upper end of the outer tube which is closed at the top.

10. Apparatus for burning spirit or similar liquid fuel including a fuel container filled with a fuel absorbing mass with a partly exposed surface from which fuel to be burned evaporates and along which combustion takes place, a draft or burner tube positioned and arranged with respect to the exposed surface to provide suction of combustion air into the tube, the fuel container being separate and removable from the rest of the apparatus and having top, bottom and side walls enclosing the absorbing means, the top wall for forming the exposed surface including a single opening which is centrally located, the area of said central opening comprising a minor portion of the total area of the top wall, a control and extinguishing disk arranged to be moved to partially or completely cover said central opening to control or extinguish the burning of the fuel, the edge of the said opening consisting of a rim portion of the top wall substantially raised above the rest of the top side of the container and having an annular upper surface against which the control and extinguishing disk is movable into contact, the side and upper walls of said rim portion, including said annular upper surface, being unbroken, said control and extinguishing disc being dished in shape with a central essentially flat circular portion and a peripheral portion with a substantially conical section to cooperate with the inside edge of said rim portion of said opening, said disc including a peripheral edge member which is at least partially separated from and axially spaced from the main disc body, said edge member including a peripheral annular portion with an upwardly directed outer edge and an inner edge portion shaped to cooperate with the outside of said annular raised portion of said rim and shaped to cooperate with the outside of said annular raised portion of said rim and said conical section peripheral portion.

11. Apparatus as claimed in claim 10 wherein the inside edge of said rim portion of said opening is raised to cooperate with said conical section of said extinguishing disk.

* * * * *

UNITED STATES PATENT AND TRADEMARK OFFICE

CERTIFICATE OF CORRECTION

PATENT NO. : 4,544,348

DATED : Oct. 1, 1985

INVENTOR(S) : KARL O.A. BOIJ

It is certified that error appears in the above-identified patent and that said Letters Patent are hereby corrected as shown below:

| | | |
|---|---|---|
| Column 1, | line 65, | "absorption" should read --absorptive--. |
| Column 2, | line 3, | "mineral wood" should read --mineral wool--. |
| Column 2, | line 54, | "that fuel container" should read --that the fuel container--. |
| Column 4, | line 9, | "flames" should read --flame--. |
| Column 9, | line 23, | "FIGS. 1-" should read --FIGS. 1-3--. |
| Column 11, | line 16, | "means" should read --mass--. |

Signed and Sealed this

*Seventeenth* Day of *December 1985*

[SEAL]

*Attest:*

DONALD J. QUIGG

*Attesting Officer*

*Commissioner of Patents and Trademarks*